US005901381A

United States Patent [19]

Nelson

[11] Patent Number: 5,901,381

[45] Date of Patent: May 11, 1999

[54] INTERCHANGEABLE HEADBAND

[76] Inventor: Lisa González Nelson, 6 Clime Ct., St. James, N.Y. 11780

[21] Appl. No.: 09/074,148

[22] Filed: May 7, 1998

[51] Int. Cl.[6] ..... A42B 1/24

[52] U.S. Cl. ..... 2/209.13; 2/171; 2/244; 2/DIG. 11; 24/458; 24/590

[58] Field of Search ..... 2/171, 209.13, 2/DIG. 11, 244; 24/458, 590; 63/29.1

[56] References Cited

U.S. PATENT DOCUMENTS

| | | | |
|---|---|---|---|
| 303,087 | 8/1884 | Wezel | 2/244 |
| 3,211,160 | 10/1965 | Miller | 132/275 |
| 4,918,758 | 4/1990 | Rendina | 2/171 |
| 5,136,726 | 8/1992 | Kellin et al. | 2/244 |
| 5,803,266 | 9/1998 | Blackwelder | 2/244 |

*Primary Examiner*—Diana L. Biefeld

[57] ABSTRACT

A decorative headband is provided including an elastic and flexible band having a top edge, a bottom edge, an outer surface, and an inner surface. The band may be fitted about a forehead of a user. Next provided is a coupling mechanism mounted on the elastic and flexible band. Also included is a plurality of decorative attachments each removably attached to the coupling mechanism.

10 Claims, 2 Drawing Sheets

INTERCHANGEABLE HEADBAND

BACKGROUND OF THE INVENTION

1. Field of the Invention

The present invention relates to headbands and more particularly pertains to a new interchangeable headband for adorning a small child.

2. Description of the Prior Art

The use of headbands is known in the prior art. More specifically, headbands heretofore devised and utilized are known to consist basically of familiar, expected and obvious structural configurations, notwithstanding the myriad of designs encompassed by the crowded prior art which have been developed for the fulfillment of countless objectives and requirements.

Known prior art headbands include U.S. Pat. No. 5,427,123; U.S. Pat. No. 5,377,360; U.S. Pat. No. 5,423,091; U.S. Pat. No. 5,426,788; U.S. Pat. No. Des. 343,282; and U.S. Pat. No. Des. 338,551.

In these respects, the interchangeable headband according to the present invention substantially departs from the conventional concepts and designs of the prior art, and in so doing provides an apparatus primarily developed for the purpose of adorning a small child.

SUMMARY OF THE INVENTION

In view of the foregoing disadvantages inherent in the known types of headbands now present in the prior art, the present invention provides a new interchangeable headband construction wherein the same can be utilized for adorning a small child.

The general purpose of the present invention, which will be described subsequently in greater detail, is to provide a new interchangeable headband apparatus and method which has many of the advantages of the headbands mentioned heretofore and many novel features that result in a new interchangeable headband which is not anticipated, rendered obvious, suggested, or even implied by any of the prior art headbands, either alone or in any combination thereof.

To attain this, the present invention generally comprises an elastic and flexible band. As shown in FIGS. 1 & 2, the band includes a strip with a rectangular configuration forming a continuous closed loop. The band has a top edge, a bottom edge, an outer surface, and an inner surface. The band further includes a circular aperture formed at a midpoint between the top edge and the bottom edge. By this structure, the band may be fitted about a forehead of a user. As best shown in FIG. 3, next provided is a coupling mechanism including a rivet. Such rivet is formed of an inner disk with a diameter greater than that of the circular aperture. The inner disk is situated against the inner surface of the band in concentric relationship with the circular aperture. Associated therewith is an outer disk with a diameter equal to that of the inner disk situated against the outer surface of the band in concentric relationship with the circular aperture. Coaxially coupled between the inner and outer disk is a first cylindrical interconnect with a diameter equal to that of the circular aperture. The coupling mechanism further includes a coupling disk with a diameter equal that of the cylindrical interconnect. Such coupling disk is coupled to the outer disk via a second cylindrical interconnect. This second cylindrical interconnect is equipped with a diameter less than that of the first cylindrical interconnect. Further, the second cylindrical interconnect resides in concentric relationship the inner and outer disk of the rivet. With reference now to FIGS. 3 & 4, a plurality of decorative attachments are provided. Each of such attachments include a piece of cloth with a circular aperture mounted to a rear extent thereof. Another rivet is provided having an inner disk with a diameter greater than that of the circular aperture of the piece of cloth. Such inner disk is situated against an inner surface of the piece of cloth in concentric relationship with the circular aperture thereof. An outer disk with a diameter equal to that of the inner disk is situated against an outer surface of the piece of cloth in concentric relationship with the circular aperture thereof. A cylindrical interconnect with a diameter equal to that of the circular aperture of the piece of cloth is integrally and coaxially coupled between the inner and outer disk of the decorative attachment. Each decorative attachment further includes a coupling cup formed of a circular face integrally and coaxially coupled to the outer disk of the rivet of the decorative attachment. A peripheral lip is integrally coupled to the circular face and extends rearwardly therefrom defining an interior space. By this structure, the coupling cup is adapted to frictionally receive the coupling disk of the coupling mechanism within the interior space thereof for removable mounting the associated decorative attachments to the band. As shown in FIG. 4, The decorative attachments include but are not limited to a flower-shaped attachment, a butterfly-shaped attachment, a bow, and a heart-shaped attachment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interchangeable headband apparatus and method which has many of the advantages of the headbands mentioned heretofore and many novel features that result in a new interchangeable headband which is not anticipated, rendered obvious, suggested, or even implied by any of the prior art headbands, either alone or in any combination thereof.

It is another object of the present invention to provide a new interchangeable headband which may be easily and efficiently manufactured and marketed.

It is a further object of the present invention to provide a new interchangeable headband which is of a durable and reliable construction.

An even further object of the present invention is to provide a new interchangeable headband which is susceptible of a low cost of manufacture with regard to both materials and labor, and which accordingly is then susceptible of low prices of sale to the consuming public, thereby making such interchangeable headband economically available to the buying public.

Still yet another object of the present invention is to provide a new interchangeable headband which provides in the apparatuses and methods of the prior art some of the advantages thereof, while simultaneously overcoming some of the disadvantages normally associated therewith.

Still another object of the present invention is to provide a new interchangeable headband for adorning a small child.

Even still another object of the present invention is to provide a new interchangeable headband that includes an elastic and flexible band having a top edge, a bottom edge, an outer surface, and an inner surface. The band may be fitted about a forehead of a user. Next provided is a coupling mechanism mounted on the elastic and flexible band. Also included is a plurality of decorative attachments each removably attached to the coupling mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
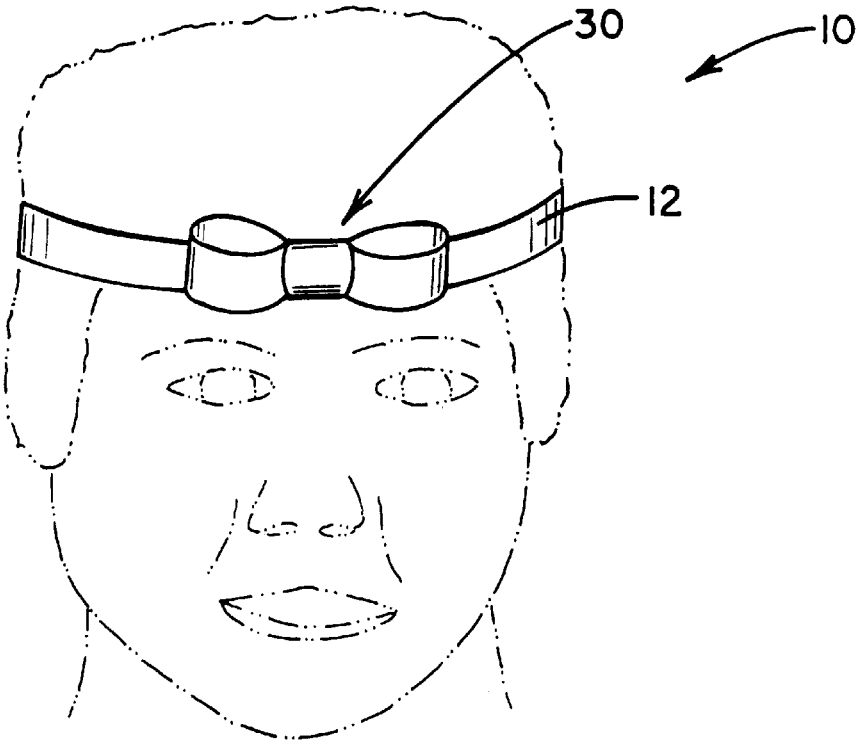
FIG. 1 is a front view of a new interchangeable headband according to the present invention.

With reference now to the drawings, and in particular to FIGS. 1 through 4 thereof, a new interchangeable headband embodying the principles and concepts of the present invention and generally designated by the reference numeral 10 will be described.

Figure 2:
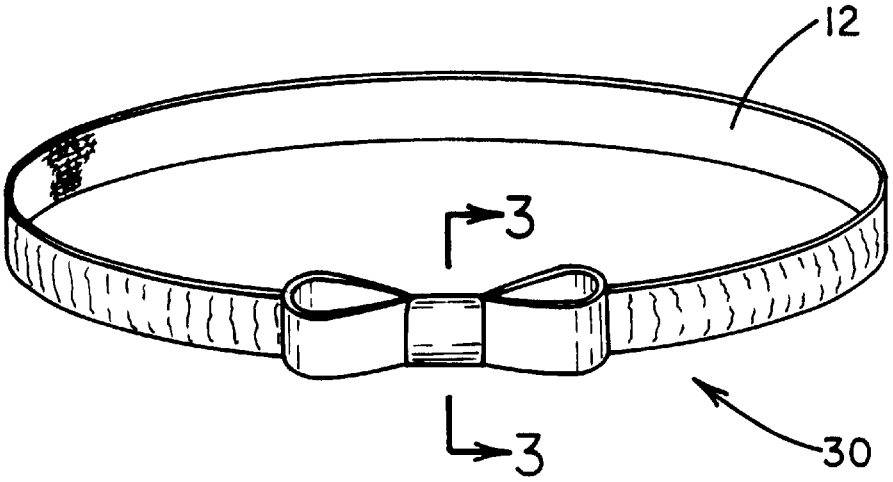
FIG. 2 is a front view of the present invention.

The present invention as designated as numeral 10 includes an elastic and flexible band 12. As shown in FIGS. 1 & 2, the band includes a strip with a rectangular configuration forming a continuous closed loop. The band has a top edge, a bottom edge, an outer surface, and an inner surface. The band further includes a circular aperture 14 formed at a midpoint between the top edge and the bottom edge. By this structure, the band may be fitted about a forehead of a user. Preferably, the band is sized to comfortably encompass the head of a small child.

Figure 3:
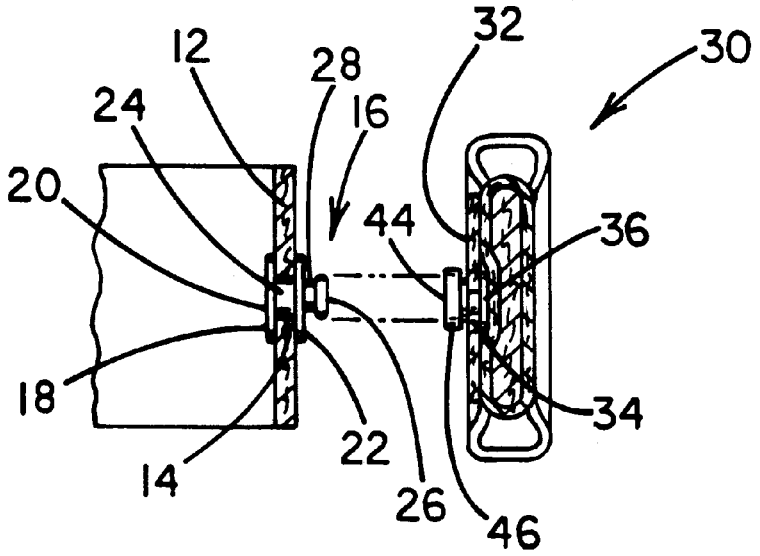
FIG. 3 is a cross-sectional side view of the present invention.

As best shown in FIG. 3, next provided is a coupling mechanism 16 including a rivet 18. Such rivet is formed of an inner disk 20 with a diameter greater than that of the circular aperture. The inner disk is situated against the inner surface of the band in concentric relationship with the circular aperture. Associated therewith is an outer disk 22 with a diameter equal to that of the inner disk situated against the outer surface of the band in concentric relationship with the circular aperture. Coaxially coupled between the inner and outer disk is a first cylindrical interconnect 24 with a diameter equal to that of the circular aperture.

The coupling mechanism further includes a coupling disk 26 with a diameter equal that of the cylindrical interconnect. Such coupling disk is coupled to the outer disk via a second cylindrical interconnect 28. This second cylindrical interconnect is constructed with a diameter less than that of the first cylindrical interconnect. Further, the second cylindrical interconnect resides in concentric relationship the inner and outer disk of the rivet. In the preferred embodiment, a cross-section of the periphery of the coupling disk taken along the axis has an arcuate configuration.

Figure 4:
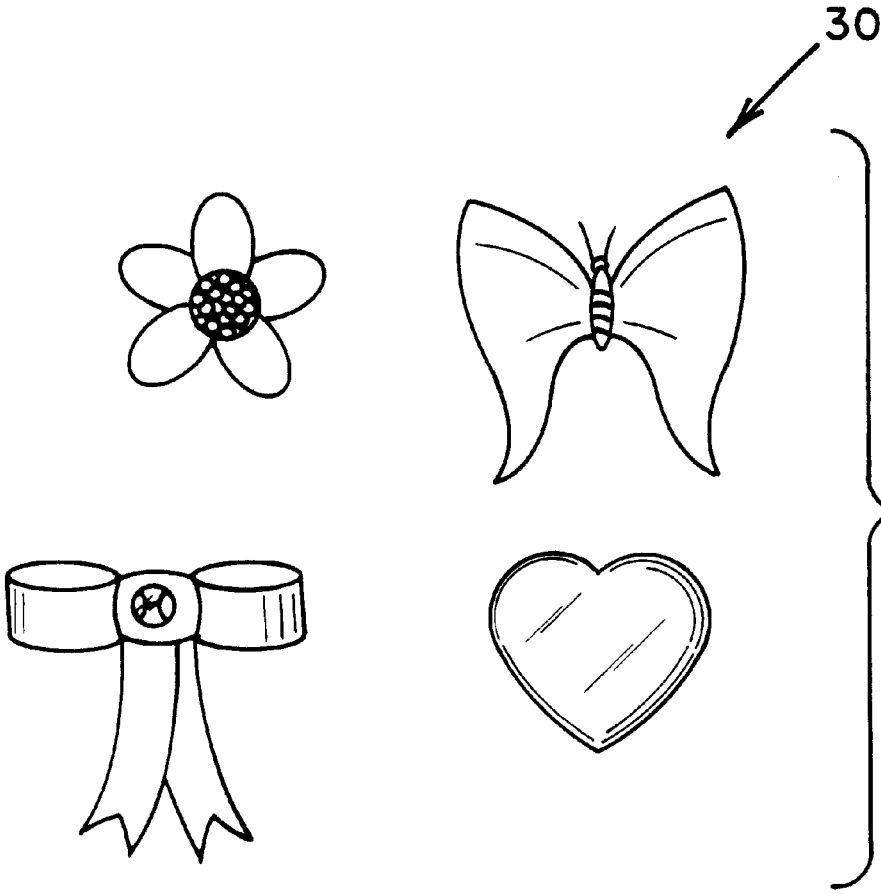
FIG. 4 is an exploded view of the various attachments of the present invention.

With reference now to FIGS. 3 & 4, a plurality of decorative attachments 30 are provided. Each of such attachments include a piece of cloth 32 with a circular aperture 34 mounted to a rear extent thereof. Such is preferably accomplished by way of a plurality of peripheral stitches which define an interior space adjacent an inner surface of the piece of cloth. Note FIG. 3. Another 36 rivet is provided having an inner disk with a diameter greater than that of the circular aperture of the piece of cloth. Such inner disk is situated against the inner surface of the piece of cloth in concentric relationship with the circular aperture thereof. An outer disk with a diameter equal to that of the inner disk is situated against an outer surface of the piece of cloth in concentric relationship with the circular aperture thereof. A cylindrical interconnect with a diameter equal to that of the circular aperture of the piece of cloth is integrally and coaxially coupled between the inner and outer disk of the decorative attachment.

Each decorative attachment further includes a coupling cup 44 formed of a circular face integrally and coaxially coupled to the outer disk of the rivet of the decorative attachment. A peripheral lip 46 is integrally coupled to the circular face and extends rearwardly therefrom defining an interior space. While not shown, a free periphery of the lip has a flange extending radially inward. By this structure, the coupling cup is adapted to frictionally receive the coupling disk of the coupling mechanism within the interior space thereof for removable mounting the associated decorative attachment to the band. In an alternate embodiment, a plurality of coupling mechanisms are mounted on various spaced locations on the band for allowing the coupling of a plurality of attachments.

As shown in FIG. 4, The decorative attachments include, but are not limited to, a flower-shaped attachment, a butterfly-shaped attachment, a bow, a heart-shaped attachment, a cartoon character, ornaments, jewelry, and the like. Such attachments may be constructed from any one of various types of material including polyester, spandex, denim, cotton and the like. Further, the attachments may include pigments of various colors to correspond to various seasons.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative headband comprising, in combination:

an elastic and flexible band including a strip with a rectangular configuration forming a continuous closed loop, the band having a top edge, a bottom edge, an outer surface, and an inner surface, the band further including a circular aperture formed at a midpoint between the top edge and the bottom edge, whereby the band may be fitted about a forehead of a user;

a coupling mechanism including a rivet having an inner disk with a diameter greater than that of the circular aperture situated against the inner surface of the band in concentric relationship with the circular aperture, an outer disk with a diameter equal to that of the inner disk situated against the outer surface of the band in concentric relationship with the circular aperture, and a first cylindrical interconnect with a diameter equal to that of the circular aperture integrally and coaxially coupled between the inner and outer disk, the coupling mechanism further including a coupling disk with a diameter equal that of the cylindrical interconnect coupled to the outer disk via a second cylindrical interconnect with a diameter less than that of the first cylindrical interconnect and in concentric relationship therewith;

a plurality of decorative attachments each including a piece of cloth with a circular aperture mounted in a rear extent thereof and a rivet having an inner disk with a diameter greater than that of the circular aperture of the piece of cloth situated against an inner surface of the piece of cloth in concentric relationship with the circular aperture thereof, an outer disk with a diameter equal to that of the inner disk situated against an outer surface of the piece of cloth in concentric relationship with the circular aperture thereof, and a cylindrical interconnect with a diameter equal to that of the circular aperture of the piece of cloth integrally and coaxially coupled between the inner and outer disk of the decorative attachment, each decorative attachment further including a coupling cup formed of a circular face integrally and coaxially coupled to the outer disk of the rivet of the decorative attachment and a peripheral lip integrally coupled to the circular face and extending rearwardly therefrom defining an interior space, whereby the coupling cup is adapted to frictionally receive the coupling disk of the coupling mechanism within the interior space thereof for removably mounting the decorative attachments to the band, the decorative attachments including a flower-shaped attachment, a butterfly-shaped attachment, a bow, and a heart-shaped attachment.

2. A decorative headband comprising, in combination:

an elastic and flexible band having a top edge, a bottom edge, an outer surface, and an inner surface, whereby the band may be fitted about a forehead of a user;

coupling means mounted on the elastic and flexible band; and a plurality of decorative attachments each removably attachable to the coupling means;

wherein the coupling means is mounted to the band by way of a rivet.

3. A decorative headband as set forth in claim 2 wherein the coupling means employs a frictional coupling to connect with the attachments.

4. A decorative headband as set forth in claim 2 wherein the rivet has an inner disk, an outer disk, and a first cylindrical interconnect integrally and coaxially coupled between the inner and outer disk, the coupling means further including a coupling disk coupled to the outer disk via a second cylindrical interconnect, wherein each decorative attachment includes a rivet having an inner disk, an outer disk, and a cylindrical interconnect integrally and coaxially coupled between the inner and outer disk of the decorative attachment, each decorative attachment further including a coupling cup formed of a circular face integrally and coaxially coupled to the outer disk of the rivet of the decorative attachment and a peripheral lip integrally coupled to the circular face and extending rearwardly therefrom defining an interior space, whereby the coupling cup is adapted to frictionally receive the coupling disk of the coupling means within the interior space thereof for removably mounting the decorative attachments to the band.

5. A decorative headband as set forth in claim 2 wherein the decorative attachments include a flower-shaped attachment, a butterfly-shaped attachment, a bow, and a heart-shaped attachment.

6. A decorative headband as set forth in claim 2 wherein the band includes a strip with a rectangular configuration forming a continuous closed loop.

7. A decorative headband comprising, in combination:

an elastic and flexible band having a top edge, a bottom edge, an outer surface, and an inner surface, whereby the band may be fitted about a forehead of a user;

coupling means mounted on the elastic and flexible band; and a plurality of decorative attachments each removably attachable to the coupling means;

wherein the decorative attachments include a flower-shaped attachment, a butterfly-shaped attachment, a bow, and a heart-shaped attachment;

wherein the coupling means includes a rivet.

8. A decorative headband as set forth in claim 7 wherein the coupling means employs a frictional coupling to connect with the attachments.

9. A decorative headband as set forth in claim 8 wherein the rivet has an inner disk, an outer disk, and a first cylindrical interconnect integrally and coaxially coupled between the inner and outer disk, the coupling means further including a coupling disk coupled to the outer disk via a second cylindrical interconnect, wherein each decorative attachment includes a rivet having an inner disk, an outer disk, and a cylindrical interconnect integrally and coaxially coupled between the inner and outer disk of the decorative attachment, each decorative attachment further including a coupling cup formed of a circular face integrally and coaxially coupled to the outer disk of the rivet of the decorative attachment and a peripheral lip integrally coupled to the circular face and extending rearwardly therefrom defining an interior space, whereby the coupling cup is adapted to frictionally receive the coupling disk of the coupling mechanism within the interior space thereof for removably mounting the decorative attachments to the band.

10. A decorative headband as set forth in claim 7 wherein the band includes a strip with a rectangular configuration forming a continuous closed loop.

* * * * *